US006116503A

United States Patent [19]

Varano

[11] Patent Number: 6,116,503

[45] Date of Patent: Sep. 12, 2000

[54] DISPOSABLE ALL-PURPOSE CONTAINER ASSEMBLY

[76] Inventor: Richard F. Varano, 156 Waterville Rd., Avon, Conn. 06001

[21] Appl. No.: 09/121,934

[22] Filed: Jul. 24, 1998

[51] Int. Cl.[7] ..... B65D 3/28

[52] U.S. Cl. ..... 229/403; 229/5.84; 229/402; 229/939

[58] Field of Search ..... 229/4.5, 5.84, 229/117.22, 117.23, 122.32, 122.33, 400, 402, 403, 939; 220/671, 739, 753, 755, 756

[56] References Cited

U.S. PATENT DOCUMENTS

| | | | |
|---|---|---|---|
| 1,771,765 | 7/1930 | Benson | 229/400 |
| 2,661,889 | 12/1953 | Phinney | 229/4.5 |
| 2,775,382 | 12/1956 | Kayat | 229/402 |
| 2,988,967 | 6/1961 | Dudnick et al. | 229/402 |
| 3,137,431 | 6/1964 | Crouse et al. | 229/4.5 |
| 3,908,523 | 9/1975 | Shikaya | 229/939 |
| 4,102,454 | 7/1978 | Karevaara | 229/402 |
| 4,230,235 | 10/1980 | Di Amico | 229/402 |
| 4,934,591 | 6/1990 | Bantleon | 229/4.5 |
| 5,147,067 | 9/1992 | Effertz | 220/739 |
| 5,697,550 | 12/1997 | Varano et al. | 229/403 |

FOREIGN PATENT DOCUMENTS

| | | | |
|---|---|---|---|
| 2716351 | 10/1977 | Germany | 229/402 |

*Primary Examiner*—Gary E. Elkins
*Attorney, Agent, or Firm*—McCormick, Paulding & Huber

[57] ABSTRACT

A disposable all-purpose container assembly includes a disposable frustoconical container formed from polymer coated paper and a saddle-like insulation attachment straddling an associated portion of the container sidewall and mounted in fixed position on the sidewall. A raw edge of the sidewall blank is sealed with polymer tape to prevent wicking or migration of liquid from the container into the sidewall. The tape also enhances the bond along the sidewall seam. The insulation attachment has a plurality of spaced apart ribs which engage the outer surface of the sidewall. The ribs, and portions of the outer surface of the sidewall and inner surface of the insulation attachment define air spaces between the container and the insulation attachment. The insulation attachment has a pair of handle sections movable to a holding position for optional use. A ribbed insulation sleeve provided with the handle sections foldable to a holding position to form a handle for optional use on a frustoconical all-purpose container of disposable type is also disclosed.

18 Claims, 2 Drawing Sheets

DISPOSABLE ALL-PURPOSE CONTAINER ASSEMBLY

FIELD OF THE INVENTION

This invention relates in general to disposable paper containers or cups.

BACKGROUND OF THE INVENTION

Schools, hospitals and other like institutions charged with the responsibility for serving food to large numbers of persons are faced with the ever increasing cost of labor associated with food preparation and service. The goal of serving wholesome food products, without risk of contamination, at reasonable cost may best be realized by minimizing food handling. In hospitals, for example, where dietary control and food quantity intake are of essential importance the advantage of using pre-prepared food products prepared under carefully controlled conditions for direct service from the original containers in which the food products are stored is readily recognized. The present invention is concerned with the aforedescribed general problems.

Accordingly, it is the general aim of the present invention to provide an improved disposable all-purpose container which may serve both as a package for a pre-prepared food product and as a serving container for the food product. A further aim of the present invention is to provide an all-purpose container for a product which may be stored in a frozen condition or under refrigeration to be served cold or which may be heated in the container by a microwave process or in a conventional convection oven to be served hot or in a warm condition. Yet another aim of the invention is to provide such a container which may be employed as a package for a dried or dehydrated product which is activated by adding hot or cold water or other liquid to the product while the product remains in the container and which may then be served in the container.

SUMMARY OF THE INVENTION

In accordance with the present invention, a disposable all purpose container assembly is provided which includes a container formed from polymer coated paper and has a generally circular bottom wall and a frustoconical sidewall. A raw edge of the sidewall blank from which the sidewall is formed is sealed with low density polyethylene tape which also enhances the bond between overlapping ends of the sidewall blank at the sidewall seam. This sidewall includes an integral annular rim which coaxially encircles the upper end of the container and defines a circular opening at the upper end. A saddle-like insulation attachment straddles an associated portion of an outer surface of the sidewall and is mounted in fixed position on the sidewall outer surface. The insulation attachment has a plurality of spaced apart ribs which extend along and project from the inner surface of the insulation attachment and engage the sidewall outer surface. The ribs and portions of the sidewall outer surface and the insulation attachment inner surface define air spaces between the container and the insulation attachment. The attachment is disposed solely to one side of an axial plane through the container and may include a handle formed by two handle sections integrally connected to the insulation attachment. In accordance with a further embodiment of the invention, the attachment may comprise a frustoconical ribbed sleeve which is received on and coaxially surrounds the container sidewall and defines a pair of handle sections for optional use.

DETAILED DESCRIPTION OF PREFERRED EMBODIMENTS

Figure 1:
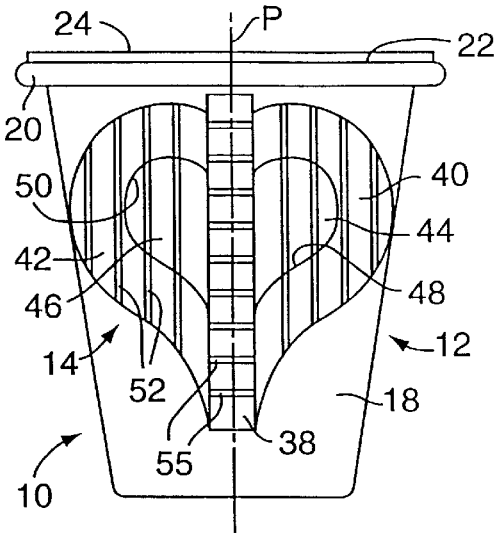
FIG. 1 is a fragmentary front elevational view of a disposable all-purpose container assembly embodying the present invention.

Turning now to the drawings and referring first particularly to FIGS. 1–4, a disposable all-purpose container assembly embodying the present invention is indicated generally by the reference numeral 10. The illustrated container assembly 10 essentially comprises a container or cup designated generally by the numeral 12 and an insulation/handle attachment secured in fixed position to the cup 12 and indicated generally at 14. The cup 12 is open at its upper end and has a substantially circular raised bottom wall 16 and a frustoconical sidewall 18. A substantially flat annular rim 20 integrally connected to the upper marginal edge portion of the sidewall 18 coaxially encircles the open upper end of the cup 12 and defines a radially disposed and upwardly facing annular sealing surface 22 for receiving a lid or diaphragm 24 which is or may be adhered to or otherwise secured in sealing engagement with the surface 22 when the container 10 is used as a sealed package for a product, as, for example, a prepared food product. The entire cup 12 is formed from paper board, virgin stock, solid bleached sulfite which preferably has a thermoplastic polymer coating on both the inner and outer surfaces thereof.

Figure 7:
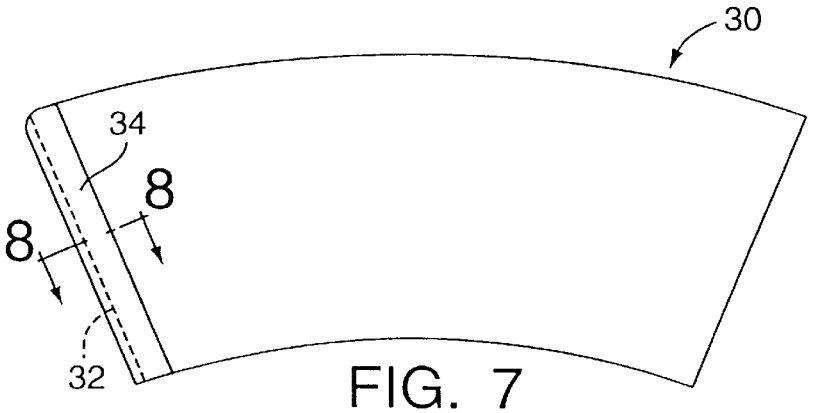
FIG. 7 is a plan view of the container sidewall blank.
Figure 8:
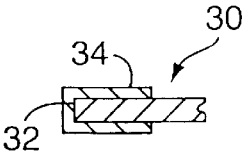
FIG. 8 is a somewhat enlarged fragmentary sectional view taken along the line 8—8 of FIG. 7.

Considering now the container assembly 10 in further detail, the cup sidewall is formed from a substantially flat arcuately die cut sidewall blank, indicated generally at 30 and shown in FIGS. 7 and 8. The sidewall blank 30 has one raw edge indicated generally at 32 sealed against entry of liquid or moisture. The end seal is preferably formed by a strip of polymer tape 34, preferably low density polyethylene tape, which extends along the one raw edge 32 and which is sealed to and along marginal portions of the blank 30 adjacent the edge 32, as best shown in FIG. 8. The sealing tape 34 may be adhered to the sidewall blank 30 using any suitable means, but, in accordance with presently preferred practice, the tape is joined to the sidewall blank by a heat sealing process. The low density polyethylene tape seal at the edge 32 prevents wicking or migration of liquid from the container and into the container sidewall through the raw edge 32. Thus, the tape seal prevents possible sidewall discoloration or container contamination which might otherwise result from contact of the contents of the container with the raw edge 32. The tape 34 also enhances bonding along the container sidewall seam, as will be hereinafter further discussed.

Figure 2:
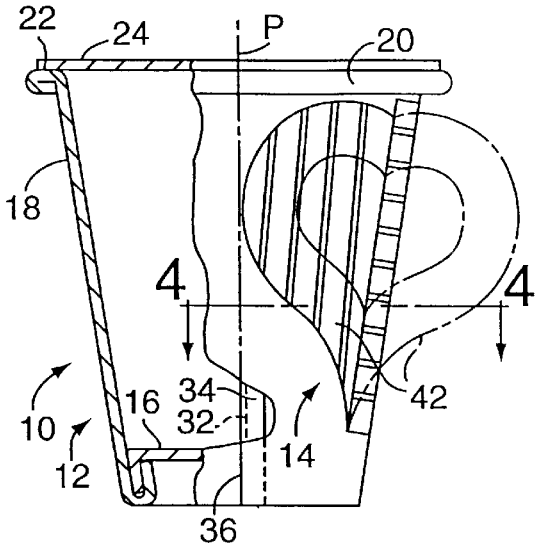
FIG. 2 is a fragmentary side elevational view of the container assembly shown in FIG. 1.
Figure 3:
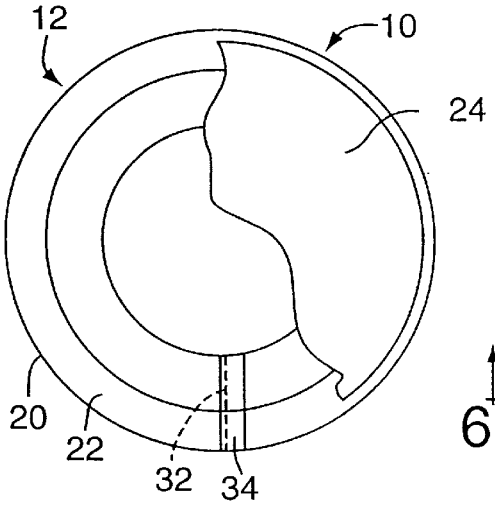
FIG. 3 is a top plan view of the container assembly shown in FIG. 1.
Figure 4:
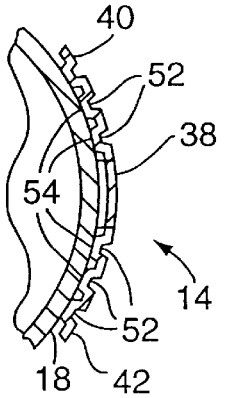
FIG. 4 is a somewhat enlarged fragmentary sectional view taken along the line 4—4 of FIG. 2.

The cup is formed in a conventional manner using a cup making machine, such as a rotary turret machine. The cup sidewall 18 is formed by joining the opposite marginal edge portions of the sidewall blank 30 in overlapping face-to-face relation to each other to form a sidewall seam 36 with the taped or sealed edge 32 within the cup and defining a portion of the inner surface of the cup, as best shown in FIG. 2 where the sidewall seam is indicated by the numeral 36. The polyethylene tape 34 provides an improved container sidewall seam 36 and bonds readily to other thermoplastic polymers, even those polymers having higher melting points than polyethylene, within the time/temperature parameter available in a normal cup manufacturing process. The use of a polyethylene tape 34 at the container sidewall seam enables one or both surfaces of the sidewall blank 30 to be coated with any thermoplastic polymer compatible with a food product or the like to be contained within the cup 12. Thus other polymers such as high density polyethylene, polyester and polypropylene, for example, may be used as a coating material for the container sidewall blank 30.

Figure 5:
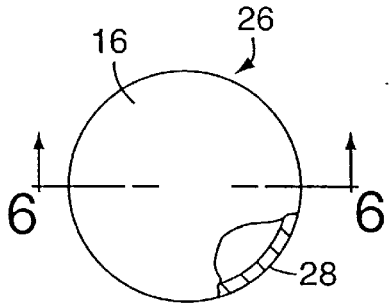
FIG. 5 is a plan view of the container bottom blank.
Figure 6:
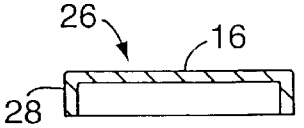
FIG. 6 is a sectional view taken along the line 6—6 of FIG. 5.

A container bottom which defines the cup bottom wall 16, is cut and drawn from a paper board blank indicated generally at 26 in FIGS. 5 and 6. The blank 26 which defines the circular bottom wall 16 also includes an annular skirt 28 which depends from the bottom wall. If the cup 12 is to be assembled by a heat sealing process at least one of the coengagable surfaces to be sealed to each other is coated with low density polyethylene. Thus, for example, if the surface of the container, sidewall blank 30 which is to define the inner surface of the cup 12 is coated with high density polyethylene, both surfaces of the container bottom will be coated with low density polyethylene. The outer surface of the low density polyethylene coated skirt 28 on the container bottom 26 is then attached in face-to-face relation to the inner surface of the cup sidewall 18, thereby forming a primary seal at the bottom of the cup. The lower marginal portion of the sidewall blank 30 is rolled and formed inwardly and upwardly into face-to-face relation with the low density polyethylene coated inner surface of the skirt 28 and adhered to the inner surface of the skirt to form a secondary seal at the cup bottom. The cup bottom and sidewalls are preferably joined by a heat sealing process, however, a suitable hot melt glue should also be satisfactory for this purpose.

The upper end portion of the sidewall blank 30 is rolled outwardly, downwardly and inwardly to form an annular bead of generally circular cross-section which is thereafter flattened to form the annular rim 20. The flattened bead defines the flat radially disposed sealing surface 22 to which a diaphragm or sealing closure may be attached to seal the open upper end of the container 10.

Figure 9:
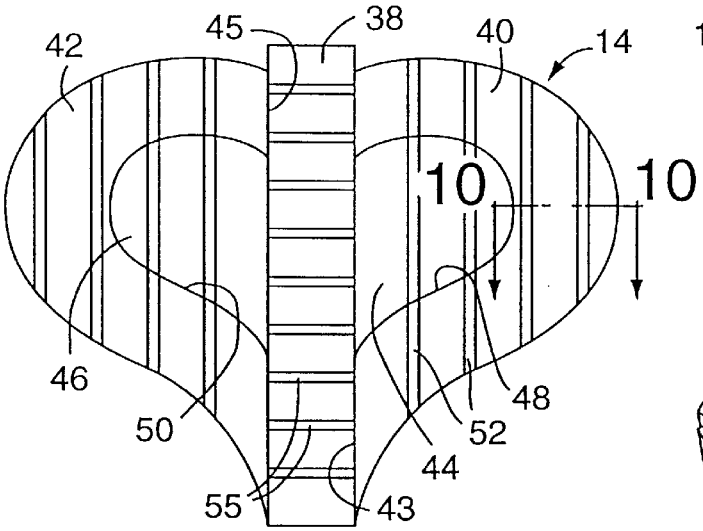
FIG. 9 is a plan view of an insulation/handle attachment blank.
Figure 10:
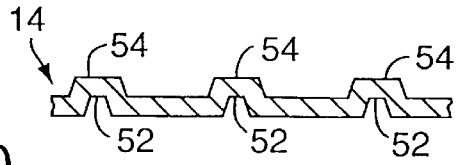
FIG. 10 is a somewhat enlarged fragmentary sectional view taken along the line 10—10 of FIG. 9.

The insulation/handle attachment 14 may be made from any suitable paper stock having sufficient strength to serve as a handle for supporting the container 10 in a filled condition. Referring further to FIGS. 9 and 10, the illustrated insulation/handle attachment 14 is die cut from paperboard stock and includes an elongated generally rectangular central connecting portion indicated at 38 and right and left hand handle sections 40 and 42, respectively, which are integrally attached to opposite sides of the central portion 38 along score or fold lines 43 and 45, substantially as shown. The die cut insulation/handle attachment 14 further includes a pair of cutout portions indicated at 44 and 46 which are integrally connected to the attaching portion 38 and separated from the handles 40 and 42 along die cut lines of separation indicated at 48 and 50, respectively. The insulation/handle attachment 14 further includes a plurality of spaced apart elongated shallow indentations 52, 52 which are produced by a forming or scoring one surface of the blank 14. The latter forming or scoring operation produces corresponding elongated ribs 54, 54 which project from the opposite side of the blank, as shown in FIG. 10. The direction of extent of the indentation 52, 52 and corresponding ribs 54, 54 relative to the insulation/handle attachment is not critical. The illustrated indentations 52, 52 and corresponding ribs 54, 54 extend in generally parallel relation to the direction of extent of the elongated central connecting portion 38. Additional indentations 55, 55 are formed in the central connecting portion 38, extend transversely of the connecting portion, and produce corresponding ribs (not shown) on the opposite side of the central portion 38.

The insulation/handle attachment 14 is applied to the container or cup 12 using a conventional handle applying apparatus of a type well known in the cup making art. The ribs formed by the indentation 55, 55, and which extend transversely of the central portion 38, are disposed in coengagement with the outer surface of the sidewall cup and are adhered to the sidewall surface. The attachment 14 may be fastened to the cup sidewall using a heat sealing process or an appropriate adhesive, such as a hot melt glue. The ribbed surfaces of the cut out portions 44 and 46 are adhesively tacked to the cup sidewall 18. However, it should be noted that the handle sections 40 and 42 are not adhered or otherwise attached to the outer surface of the cup sidewall 18.

In assembly with the cup 12, the saddle-like insulator/handle attachment 14 straddles a portion of the cup sidewall 18. It should be noted that the insulator/handle attachment 14 lies entirely to one side of a diametric plane of the cup 12, such a plane being shown in FIGS. 2 and 3, and indicated by the letter P.

The ribbed configuration of the insulator/handle attachment 14 cooperates with the cup sidewall 18 to provide air spaces between the attachment 14 and the cup sidewall. Thus, the attachment 14 serves as an insulating patch on the cup which provides a region where the cup may be comfortably grasped when it contains a hot or cold substance. Since the handle sections 40 and 42 are not secured to the cup sidewall, these handle portions may be freely moved to a holding position shown in broken lines in FIG. 2. In the latter position portions of the two handle sections are disposed in generally side-by-side relation to each other and form a convenient handle for holding the container. Use of the handle is optional. If the container 10 is used to serve hot soup, for example, it may be preferable not to use the handle, since the cup will normally be resting on a table surface or the like while the hot soup is being consumed. However, if the container is used to serve a hot beverage such as coffee, it may be preferable to use the handle, since the cup will normally be hand held while the beverage is being consumed.

The raised bottom of the container 10 enables the container to be nested with other containers of like kind for convenient storage. The design of the container is such that food may be stored in the container which may be sealed with an appropriate sealing lid or diaphragm, such as the diaphragm 24. Further, the container is suitable for freezing a product which it contains or maintaining the product at refrigeration temperature, as desired. The use of a heavy duty polymeric coating on either or both the inner and outer surface of at least the sidewall of the container renders the container oven friendly so that it may be heated to a reasonable temperature in a conventional convection oven as well as in a microwave oven, if so desired.

Figure 11:
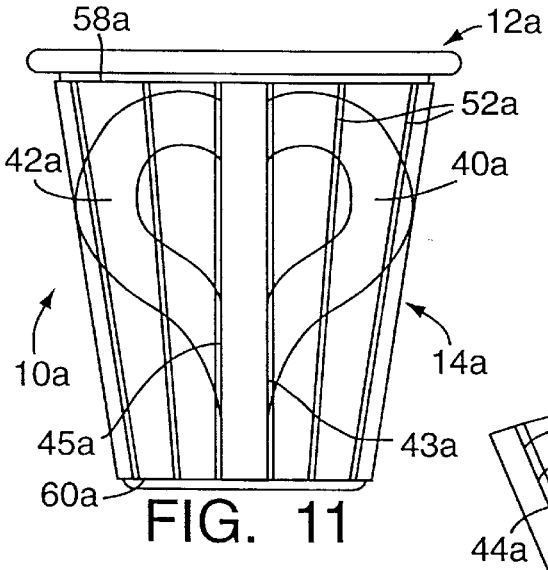
FIG. 11 is a front elevational view of another all-purpose container assembly embodying the present invention.
Figure 12:
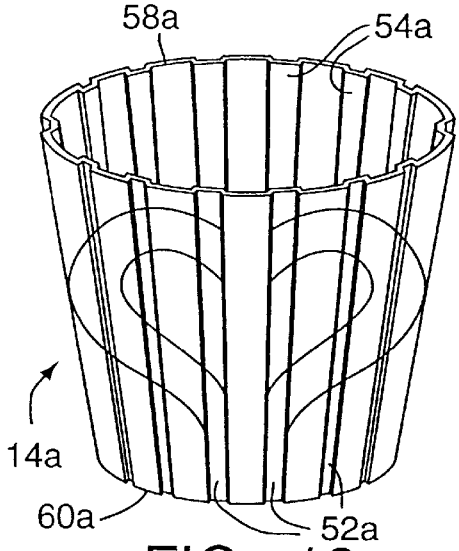
FIG. 12 is a perspective view of the insulation/handle sleeve attachment of the container of FIG. 11.

Referring now to FIGS. 11 and 12 another disposable all-purpose container embodying the present invention is indicated generally by the reference numeral 10*a*. The illustrated container assembly 10*a* comprises a container or cup 12*a* and an insulator/handle attachment designated generally by the reference numeral 14*a*. The container or cup 12*a* is substantially identical in all respects to the container or cup 12, previously described, and for this reason the cup 12*a* will not be further described. However, the insulator/handle assembly designated generally at 14*a* differs substantially from the corresponding insulator/handle assembly 14 previously described. Specifically, the attachment 14*a* substantially comprises an insulating sleeve which includes a handle for optional use.

Figure 13:
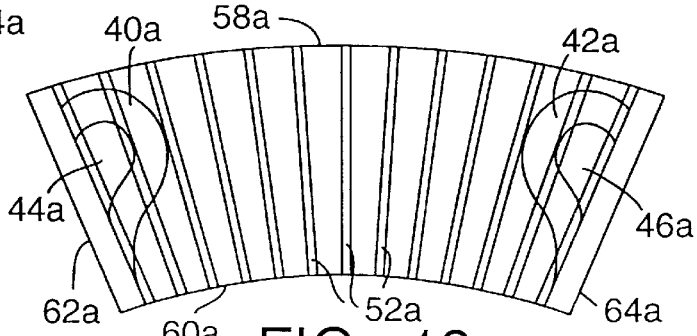
FIG. 13 is a plan view of an insulation/handle sleeve blank.

The illustrated sleeve 14*a* is formed from paperboard by a cutting or blanking operation and has arcuate upper and lower edges indicated by the numerals 58 and 60, respectively. The arcuate upper and lower edges have a common center of curvature but differing radii of curvature. The blank is further defined by radially extending opposite end edges 62*a* and 64*a* centered at the common center of curvature. A plurality of spaced apart and shallow radially extending indentations 52*a*, 52*a* formed in one surface of the sleeve blank produce corresponding radially extending ribs 54*a*, 54*a* which project from the opposite or inner surface of the sleeve blank as shown in FIG. 13. The blank 14*a* also includes two die cut handle sections 40*a* and 42*a*. Each of the handle sections 42 and 42*a* is integrally connected to a marginal end portion of the blank 14*a* in spaced relation to an associated end edge of the blank, substantially as shown in FIG. 13. The cutout portions of the handle sections, indicated at 44*a* and 46, may, if desired, be removed from the sleeve blank. The sleeve 14*a* is formed by adhesively joining the marginal end portions of the sleeve blank in overlying face-to-face relation to each other. The frustoconical insulation/handle sleeve 14*a* is preferably formed as a separate unit from the cup 12*a* to be slipped onto the cup when the cup is used. It will be noted that the handle sections 40*a* and 42*a* are adjacent the sleeve seam formed by the overlapping marginal portions 62*a* and 64*a*. Thus, the double thickness seam imparts both strength and insulation qualities to the handle.

Figure 14:
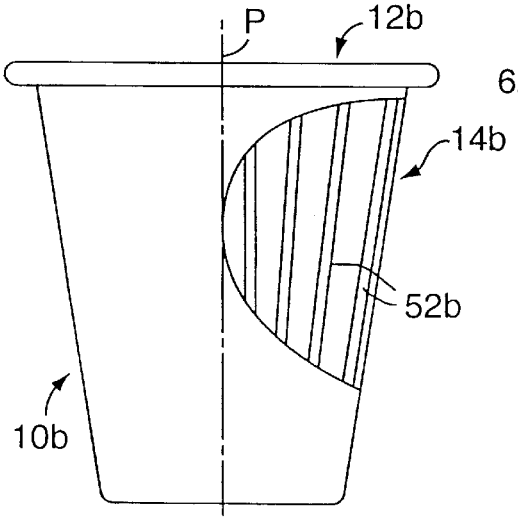
FIG. 14 is a side elevational view of still another all-purpose container embodying the present invention.
Figure 15:
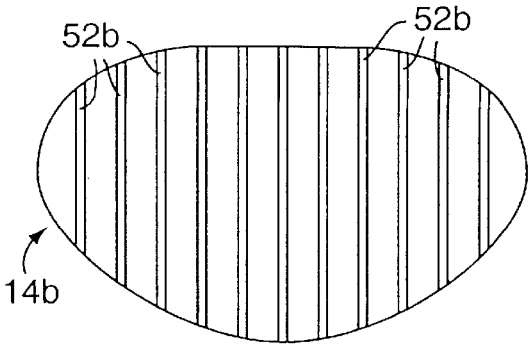
FIG. 15 is a plan view of the insulating blank attachment of the container shown in FIG. 14.

Another disposable all-purpose container assembly embodying the present invention is shown in FIGS. 14 and 15 and indicated generally by the referenced numeral 10*b*. The illustrated cup 12*b* is substantially identically to the cup 12 previously described. However, the insulation attachment 14*b* does not include a handle and essentially comprises a patch of paperboard attached to the cup to provide an insulated region of somewhat limited area to facilitate comfortable handling of a cup which may contain a heated or frozen product, for example. The saddle-like attachment or patch 14*b* may take various forms. However, the patch 14*a* is preferably constructed and arranged to straddle an associated portion of the cup 12*b* and lie entirely to one side of diametric plane through the cup, such a plane being indicated by the letter P in FIG. 14. A typical insulation attachment or patch 14*b* shown in FIG. 15 may be made from any suitable paperboard material and includes a plurality of spaced apart indentations 52*b*, 52*b* formed in one surface of the material thereby producing ribs projecting from the opposite surface of the patch, but not shown. The patch 14*b* is adhered to the cup 12*b* with the ribs engaging the outer surface of the cup sidewall so that air spaces are provided between the cup sidewall, the inner surface of the patch, and each pair of adjacent ribs, whereby an associated portion of the cup is insulated to facilitate comfortable handling.

I claim:

1. A disposable all-purpose container assembly comprising a container formed from polymer coated paper and having a generally circular bottom wall and sidewall including an integral annular rim coaxially encircling said container at its upper end and defining a circular opening at said upper end, and an a saddle-like insulation attachment straddling an associated portion of an outer surface of said sidewall and mounted in fixed position on said sidewall outer surface, said insulation attachment having a plurality of spaced apart ribs, said ribs extending along and projecting from an inner surface of said insulation attachment and engaging said sidewall outer surface, said ribs and portions of said sidewall outer surface and said insulation attachment inner surface defining air spaces between said container and said insulation attachment, said insulation attachment being wholly disposed to one side of an axial plane through said container.

2. A disposable all-purpose container assembly as set forth in claim 1 wherein said insulation attachment is further characterized as an insulation/handle attachment having a handle movable from an inactive position wherein said handle is disposed generally adjacent said sidewall outer surface and a holding position wherein said handle projects generally radially outwardly from said container.

3. A disposable all-purpose container assembly as set forth in claim 2 wherein said insulation/handle attachment includes a central portion and said handle includes right and left hand handle sections integrally attached to opposite sides of said central portion along score lines and foldable along said score lines to said holding position wherein said handle sections define said handle.

4. A disposable all-purpose container assembly as set forth in claim 3 wherein said central portion is further defined as a longitudinally elongated central portion and said ribs extend in generally longitudinal directions.

5. A disposable all-purpose container assembly as set forth in claim 3 wherein said central portion is further characterized as elongated longitudinally extending central portion and said ribs extend in transverse directions across said central portion.

6. A disposable all-purpose container assembly as set forth in claim 3 wherein said right and left hand handle sections include cut out portions separated from said handle sections and integrally connected to said central section, said cut out portions being attached in fixed position to said sidewall outer surface.

7. A disposable all-purpose container assembly as set forth in claim 1 wherein said container includes an inner surface coated with a first polymer and an outer surface coated with a second polymer.

8. A disposable all-purpose container assembly as set forth in claim 7 wherein said first polymer comprises a light duty polymer and said second polymer comprises a heavy duty polymer.

9. A disposable all-purpose container assembly as set forth in claim 8 wherein said first polymer comprises polyethylene.

10. A disposable all-purpose container assembly as set forth in claim 9 wherein said second polymer comprises polyethylene.

11. A disposable all-purpose container assembly as set forth in claim 8 wherein said second polymer comprises polypropylene.

12. A disposable all-purpose container assembly as set forth in claim 8 wherein said second polymer comprises a polyester.

13. A disposable all-purpose container assembly as set forth in claim 12 wherein said container sidewall includes a seam formed by overlapping end portions of said sidewall joined in face-to-face relation to each other and one of said end portions is disposed within an interior of said container and container and includes a sealed edge portion.

14. A disposable all-purpose container assembly as set forth in claim 13, wherein said one end portion carries a strip of sealing tape forming a seal for said sealed edge portion.

15. A disposable all-purpose container assembly as set forth in claim 14 wherein said sealing tape forms a portion of said seam.

16. A disposable all-purpose container assembly as set forth in claim 15 wherein said sealing tape comprises polyethylene tape.

17. A disposable all-purpose container assembly comprising a container formed from polymer coated paper and having generally circular bottom wall and a frustoconical sidewall including an integral annular rim coaxially encircularing said container at its upper end and defining a circular opening at said upper end, and an insulation/handle attachment including a frustoconical sleeve coaxially surrounding said sidewall, said sleeve including an outer surface having spaced apart indentations therein defining corresponding ribs projecting inwardly from an inner surface of said sleeve, said ribs engaging an outer surface of said sidewall, said sleeve having right and left hand handle sections cut therefrom and integrally joined to said sleeve along score lines for movement from an inactive position wherein said handle sections are disposed generally adjacent said sidewall and a holding position wherein portions of said right and left hand handle sections are disposed in generally face-to-face relation to each other and form a handle projecting generally radially outwardly from said sidewall.

18. A disposable all-purpose container assembly as set forth in claim 17 wherein said sleeve has a longitudinally extending side seam formed by marginal end portions of said sleeve disposed in overlapping face-to-face relation to each other and said handle sections are integrally connected to said sleeve at opposite sides of said side seam.

* * * * *